US005489931A

United States Patent [19]

Shibata et al.

[11] Patent Number: 5,489,931

[45] Date of Patent: Feb. 6, 1996

[54] FLUID DELIVERY SYSTEM INCLUDING COILED CONCENTRIC TUBES

[75] Inventors: Alan Shibata, Camas; Eric L. Ahlvin, Vancouver, both of Wash.

[73] Assignee: Hewlett-Packard Company, Palo Alto, Calif.

[21] Appl. No.: 249,500

[22] Filed: May 26, 1994

[51] Int. Cl.[6] ..... B41J 2/175

[52] U.S. Cl. ..... 347/85; 138/111; 138/131

[58] Field of Search ..... 347/85, 86; 346/140.1; 138/107, 133, 118, 111, 131, D5

[56] References Cited

U.S. PATENT DOCUMENTS

| | | | |
|---|---|---|---|
| 3,102,770 | 9/1963 | McKeegan | 346/140.1 |
| 3,487,858 | 1/1970 | Hanback | 138/118 |
| 4,771,295 | 9/1988 | Baker et al. . | |
| 4,831,389 | 5/1989 | Chan . | |
| 4,929,963 | 5/1990 | Balazar . | |
| 5,025,270 | 6/1991 | Umezawa | 347/85 |
| 5,119,726 | 6/1992 | Dörsam . | |

FOREIGN PATENT DOCUMENTS

| | | | |
|---|---|---|---|
| WO87021 | 4/1987 | WIPO | 138/118 |

*Primary Examiner*—Benjamin R. Fuller
*Assistant Examiner*—Kevin Saunders

[57] ABSTRACT

A system is herein disclosed for use in the delivery of fluid from a reservoir to a relatively reciprocating fluid discharge mechanism via an arrangement of coiled tubes which may be expanded or retracted with reciprocation of the discharge mechanism. The system is preferably arranged with a series of concentrically coiled tubes, each tube carrying a different fluid to the discharge mechanism. Adjacent coils are wrapped in opposing rotational directions so as to create a web-like matrix which supports the coils in their extended form.

7 Claims, 2 Drawing Sheets

FLUID DELIVERY SYSTEM INCLUDING COILED CONCENTRIC TUBES

TECHNICAL FIELD

The present invention relates generally to fluid delivery systems, and more particularly, to a system which delivers fluid from a stationary reservoir to a reciprocating discharge mechanism via a plurality of concentrically coiled tubes. Although the invention has broad utility, it has proven particularly well suited for use as an ink delivery system in an ink jet printer, and is described in that context below.

BACKGROUND ART

In a conventional ink jet printer, ink is deposited on record media such as paper via a disposable pen, the pen being mounted on a carriage for reciprocation across the paper's face. Ink is ejected through the pen's printhead, the printhead being connected to a volume of ink which is stored in a reservoir onboard the pen. When the ink reservoir is depleted, the pen is removed from the carriage, discarded, and replaced with a new pen. An example of such a pen is disclosed in U.S. Pat. No. 4,771,295, which is entitled "Thermal Ink Jet Pen Body Construction Having Improved Ink Storage and Feed Capability", and which is commonly owned herewith. The disclosure of that patent is incorporated herein by this reference.

In order to extend the useful life of ink jet pens, several off-axis ink supply approaches have been suggested whereby the pen's onboard ink reservoir is refilled. These approaches have included the use of a second, off-board ink supply, generally in the form of a larger ink reservoir positioned at a location which is remote from the pen. As the pen's onboard supply of ink is depleted, substitute ink is delivered from the off-board reservoir through an arrangement of one or more tubes. The larger ink reservoir thus allows for use of the pen beyond the duration of the its onboard ink supply, effectively extending the pen's lifetime to coincide with the lifetime of the its associated printhead. An illustrative example of such an approach is provided in U.S. Pat. No. 4,831,389, which is entitled "Off Board Ink Supply System and Process for Operating an Ink Jet Printer", and which is commonly owned herewith. The disclosure of that patent is incorporated herein by this reference.

Although known off-axis ink supply approaches generally have been effective in extending the lifetime of a printer's pen, there remains room for improvement, particularly in the manner by which ink is delivered to the pen. In the past, ink has been delivered via flexible tubing which runs from the off-board ink supply to the reservoir within the pen. The tubing generally extends as a linear segment, each tube having a length which allows for reciprocation of the pen. As the pen reciprocates, and the distance between the pen and off-board reservoir changes, the tubing is folded over on itself so as to take up the resulting slack.

This tubing arrangement has led to a number of problems, due in large part, to the effects of tube folding during reciprocation of the pen. Such folding, for example, will often produce an unacceptably high stress on the tube, increasing tube fatigue, and correspondingly decreasing the lifetime of the tube. In addition, folding of the tubes may result in an undesirably high torque on the pen, increasing the power required to drive the pen. Further, because the folding of tubes requires a significant amount of clearance, the use of off-axis ink supplies has resulted in a significant increase in the printer's size. The latter problem is particularly troublesome where a multi-color pen is employed, it being necessary to run a plurality of tubes (one for each color) between the reservoir and the reciprocating pen.

It is therefore a general object of this invention to provide a fluid delivery system whereby fluid may be delivered from a stationary reservoir to a reciprocating discharge mechanism without the stress caused by folding or extreme bending of tubes. More specifically, the invention is intended to provide an off-axis fluid delivery system wherein tubes are formed helically so as to allow expansion and retraction of the tubes without imposing undue stress or fatigue.

Another general object of the invention is to provide an off-axis fluid delivery system which employs tubes to deliver fluid from a stationary reservoir to a discharge mechanism without unduly burdening discharge mechanism reciprocation. This relates most directly to the minimization of torque on the discharge mechanism by the tubes, such minimization being made possible by effecting a decrease in the drag produced by the tubes. It is therefore an object of the invention to provide a fluid delivery system which delivers fluid through tubes formed in spring-like coils.

Yet another general object of the invention is to provide an off-axis fluid delivery system with multiple tubes which optimizes the space such tubes occupy. Specifically, it is intended to provide a fluid delivery system which interconnects a stationary reservoir and a reciprocating discharge mechanism via a plurality of concentrically coiled tubes.

DISCLOSURE OF THE INVENTION

The present invention overcomes most, if not all, of the problems with prior off-axis ink supply approaches by provision of an fluid delivery system which includes a plurality of coiled tubes. The tubes provide for the delivery of fluid from a stationary reservoir to a reciprocating fluid discharge mechanism, such discharge mechanism preferably taking the form of an ink jet printer's pen. The tubes are coiled along an axis which is substantially parallel to the axis of discharge mechanism reciprocation, and are arranged concentrically so as to optimize the system's use of space. The coils expand and retract with each pen reciprocation, effectively varying the span of the tubes. Adjacent tubes are coiled in opposite directions, creating a web-like matrix which provides structural support for the tubes in their extended form.

DETAILED DESCRIPTION AND BEST MODE FOR CARRYING OUT THE INVENTION

As stated above, the present invention relates to a system for use in delivering fluid from a reservoir to a relatively reciprocable discharge mechanism via a helical arrangement of tubes. Although the invention has broad utility, it has proven especially well suited for use as a printer's ink delivery system, and is described for use within such a printer below. Specifically, the system is described in the context of an ink jet printer which employs an off-axis ink supply approach.

Figure 1:
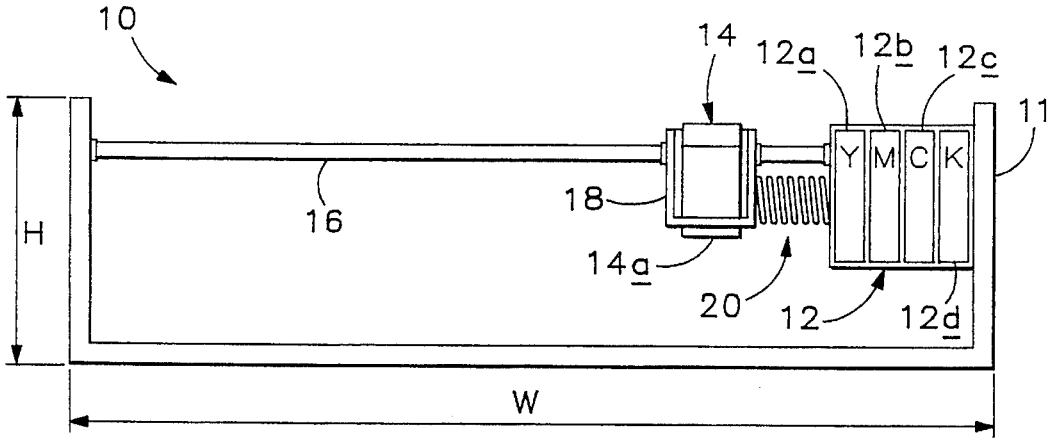
FIG. 1 is a somewhat schematic front elevational view of a printer which incorporates a fluid delivery system in accordance with the present invention.

Referring initially to FIG. 1, it will be noted that a conventional ink jet printer has been depicted schematically, the printer being indicated generally at 10. As shown, the printer includes a chassis 11, the chassis being sized to contain the printer's working parts. In the preferred embodiment the chassis has a height H of approximately 8-inches, a width W of approximately 17-inches, and a depth of approximately 14-inches. This represents a chassis of conventional size.

In accordance with the invention, printer 10 employs an off-axis ink supply approach, the printer including a reservoir 12 which periodically supplies ink to a reciprocating pen 14. The pen reciprocates along a reciprocation axis (A in FIGS. 2 and 3), such axis being defined along a transverse shaft 16. The pen is mounted on a carriage 18, which in turn is mounted for movement on the shaft. The carriage is bidirectionally movable along the shaft using a processor-controlled motor (not shown), such movement effectively reciprocating the pen across a media sheet for deposit of ink through the pen's printhead 14*a*. Ink is delivered from the reservoir to the pen via a tube arrangement 20 which embodies the invented fluid delivery system as will be described in detail below.

Focussing for a moment on reservoir 12, and referring still to FIG. 1, it will be noted that such reservoir is stationary, the reservoir being fixed relative to the printer's chassis 11. Ideally, the reservoir is positioned to afford easy access thereto for refilling, while avoiding interference with the printer's working parts. Toward this end, the reservoir may form a part of the printer's chassis, or be secured to one of the chassis side walls as is shown in FIG. 1.

As indicated, reservoir 12 is a multi-compartment structure, each compartment 12*a*, 12*b*, 12*c*, 12*d* providing for the containment of a separate charge of ink for communication to the printer's pen. It is to be noted that the reservoir's compartments are replenishable, allowing for extension of the pen's useful life even beyond the duration of ink in the off-board ink supply. Replenishment generally is accomplished by installation of a new cartridge or bottle of ink, but may be accomplished in a variety of different ways.

In the preferred embodiment, the reservoir carries four different inks, such inks being indicated by the letters Y, M and C and K. The letters Y, M and C designate yellow, magenta and cyan ink, respectively. The letter K designates black ink. Each ink is contained in a separate compartment, the compartments being connected to pen 14 via tube arrangement 20. The tube arrangement, it will be recalled, includes four distinct tubes, allowing for each of the compartments to be connected to the pen by a separate tube.

Pen 14 also includes an onboard reservoir made up of a plurality of onboard compartments (not shown), each of which is adapted to receive a separate supply of ink from the off-board reservoir 12. Once received, the ink is temporarily stored in the pen's onboard reservoir, and then passed on to the pen's printhead 14*a* as needed for printing. Additional ink is delivered to the pen from the off-board reservoir, through tube arrangement 20.

Ink is thus supplied to the pen via a process which involves: (1) providing a remote source of ink in an off-board reservoir; (2) providing an ink flow path between the off-board reservoir and the pen; and (3) delivering ink from the off-board reservoir, through the ink flow path, and into the pen. The ink flow path takes the form of tube arrangement 20 which defines the invented fluid delivery system as will now be described.

Figure 2:
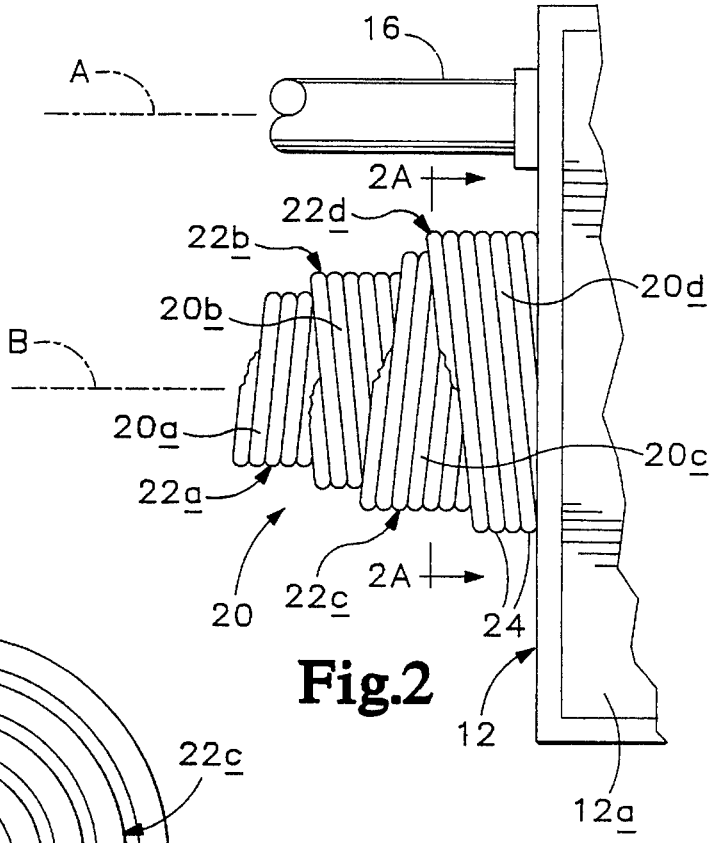
FIG. 2 is a fragmentary front elevational view of a fluid delivery system which includes a plurality of concentrically coiled tubes arranged in accordance with a preferred embodiment of the invention.
Figure 3:
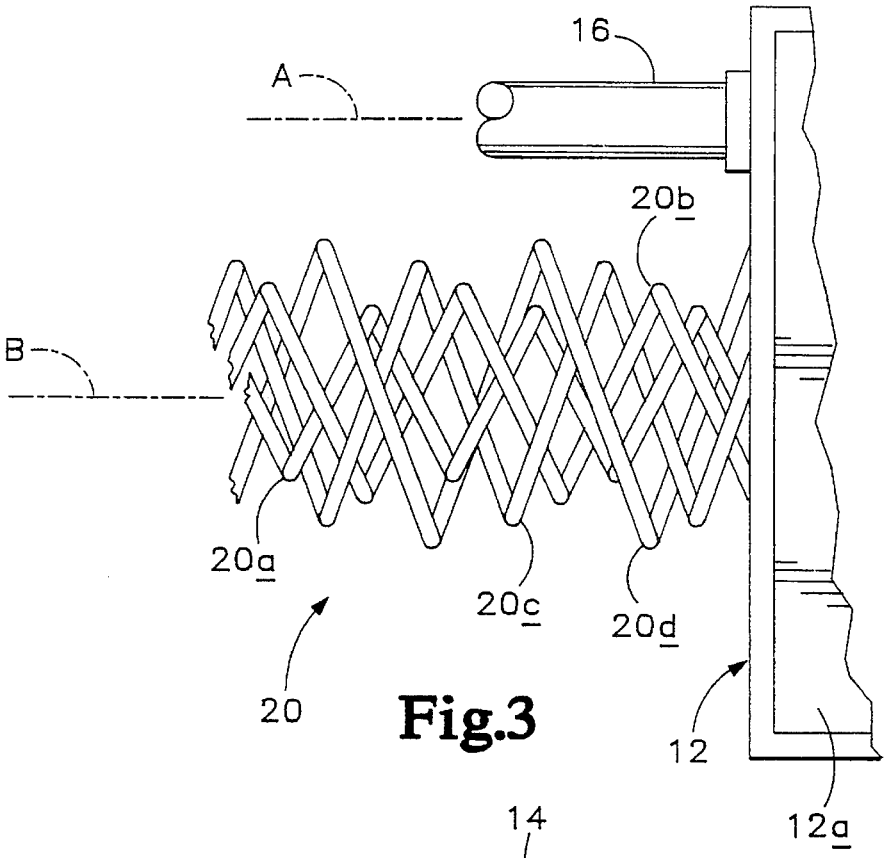
FIG. 3 is a fragmentary front elevational view of the fluid delivery system depicted in FIG. 2, the tube coils being expanded so as to illustrate a change in tube orientations upon reciprocation of the printer's pen.

Referring now to FIGS. 2 and 3, it will be noted that tube arrangement 20 includes a plurality of tubes 20*a*, 20*b*, 20*c*, 20*d*, each tube connecting an ink compartment of reservoir 12 to a corresponding onboard ink compartment of pen 14. As shown, the tubes are arranged to form a series of elongate helical coils, 22*a*, 22*b*, 22*c*, 22*d*, each of which includes a plurality of windings (or turns) 24. The coils extend along a coil axis B, defining what amount to a series of elongate springs. Axis B, is substantially parallel to the pen's reciprocation axis A, providing for the expansion and retraction of the coils along axis B with each reciprocation of the pen. This in turn provides the delivery system with a tube arrangement which effectively varies in transverse length. FIG. 2 shows all of the coils completely retracted. FIG. 3 shows the coils expanded relative to their orientation in FIG. 2. It thus will be appreciated that the coils expand along axis B in generally linear fashion so as to minimize the torque on the pen carriage and off-board reservoir.

Figure 4:
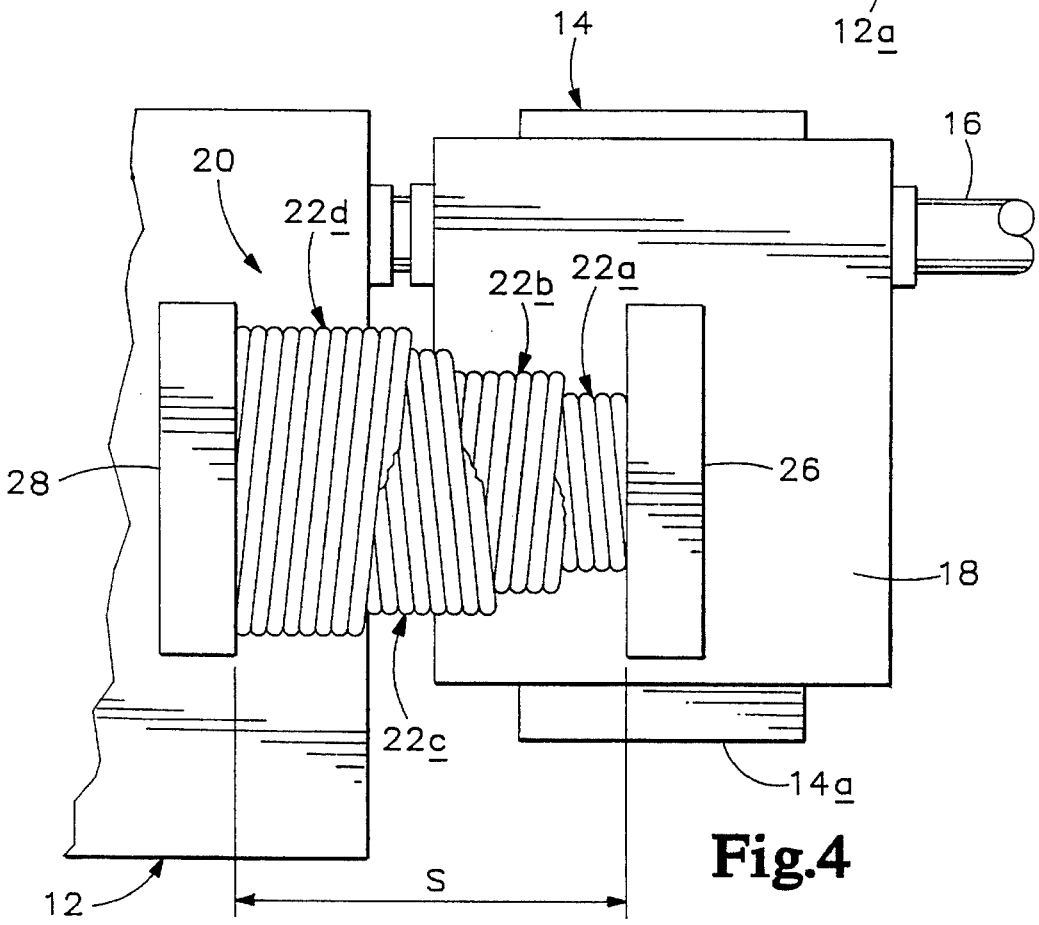
FIG. 4 is a fragmentary rear elevational view of the fluid delivery system depicted in FIG. 2, the tube coils being completely retracted.

The tubes are formed of a material which has a good physical memory, each tube being arranged such that the tube's undeformed orientation corresponds to the orientation of a completely collapsed spring (FIGS. 2 and 4). As the pen moves, the coils are deformed along axis B, such deformation being opposed by spring-like effect of the coils. Pen reciprocation thus will be opposed in one direction, and aided in an opposite direction, also, by spring-like effect of the coils. In the preferred embodiment, the chosen tube material is substantially stiff, providing coils with the desired dynamic response. Exemplary tubes, will be formed of materials such as teflon, nylon, vinyl or urethane, all of which have been found to be suitable for the transfer of ink.

Tube dimensions are chosen to afford optimal passage of fluid, but the dimensions are kept small so as to optimize the tube arrangement's occupied space. In the preferred embodiment, the tubes have exterior diameters of approximately 0.0725-inches, and internal diameters of approximately 0.0625-inches, diameters which have proven acceptable for use in the transfer of ink. Those skilled, however, will appreciate that these diameters may vary in accordance with the particular fluid which is to be communicated therethrough.

Figure 2A:
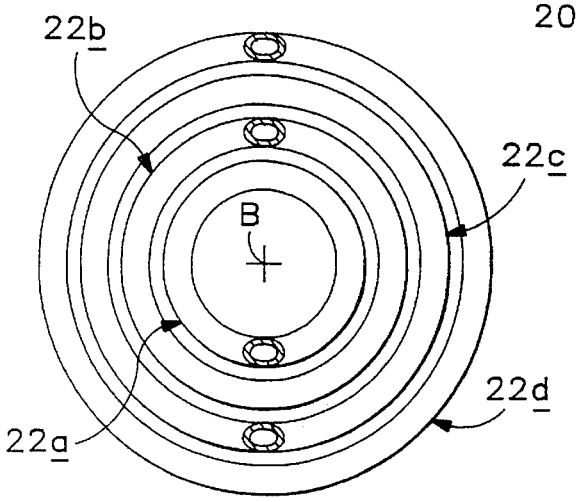
FIG. 2A is a sectional side view of the preferred embodiment tubes, the view being taken generally along line 2A—2A of FIG. 2.

In accordance with one of the principal features of the invention, the tubes are coiled with different coil diameters, and arranged concentrically along a common axis B. This arrangement is best illustrated in FIG. 2A which shows the coils in side section. As indicated, each coil preferably varies in diameter relative to adjacent coils by an amount which roughly equals the diameter of that coil's tube, making for an arrangement of closely spaced concentric coils. In the preferred embodiment, coil diameters generally range from approximately 1½-inches to 2½-inches, providing an overall coil arrangement with a vertical span (in FIGS. 1–4) of approximately 2½-inches, a span which will fit in a printer chassis of conventional size.

Referring again to FIGS. 2 and 3, it is to be noted that each coil is arranged to support an outwardly adjacent coil by winding of adjacent coils such that the turns of the coils overlap. Coils 22*a* and 22*c*, for example, are wound in a first rotational direction. This results in windings 24 which slant upwardly and to the right (in FIG. 2). Coils 22*b* and 22*d* are wound in a second, opposite rotational direction, resulting in windings 24 which slat upwardly and to the left (in FIG. 2). The system thus is provided with a tube arrangement with enhanced structural support. FIG. 3 makes clear the effect of opposite direction windings when the coils are expanded, the tubes crossing over one another to define a web-like matrix. Such matrix provides additional structural support for the extended coils which might otherwise differently sag under their own weights. Coil sag could lead to problems in retracting the coils due to entanglement of the various tubes (as by passage of one coil's windings through spacings between the windings of another coil), could increase torque on the pen carriage, and could result in interference with the printer's other working parts.

FIG. 4 illustrates the arrangement whereby, the tubes run between the printer's pen and ink reservoir, each tube having a first end connected to a reservoir manifold 28 and a second end connected to a pen manifold 26. The manifolds generally are of conventional design, connecting each tube to corresponding ink compartments of the reservoir and pen. Reservoir manifold 28, for example, forms a part of reservoir 12 and includes passages which communicate with compartments 12*a*–12*d*. Pen manifold 26 forms a part of the carriage 18 and includes passages which similarly communicate with onboard compartments of the pen.

FIG. 4 shows the tube arrangement 20 in its completely retracted form, pen 14 having been moved to a position closely adjacent the printer's ink reservoir 12. In this arrangement, the tube coils 22*a*–2*d* are completely retracted, the coil windings being immediately adjacent one another so as to define a coil with substantially continuous side walls. The coil lengths, in such completely retracted orientations, are defined herein as the coils' solid lengths, the solid length of coil 22*a* being indicated in FIG. 4 at S. Length S preferably will be kept to a minimum so as to minimize printer size, but must be of a length which allows reciprocation of the pen. Length S, it will be understood, depends on the number of tube windings 24.

The maximum extent of coil expansion is determined by the diameter of the coils and by the number of coil windings. Therefore, although all four tubes are shown in the completely retracted orientation in FIG. 4, those skilled will appreciate that coils 22*b*–22*d* generally will not be completely retracted, such coils being capable of a greater extents of expansion as the coil diameters increase.

Although a preferred embodiment of the invention is shown those skilled in the art will appreciate that various modifications may be made in the above described embodiment without departing from the scope of the invention as claimed. For example, many modifications to the particular structure of the individual tubes may be made which will avoid clogging or other failure of the tubes. Also, although the invented fluid delivery system is described for use within a multi-color printer with a particular ink combination, it is similarly useful in printers which employ different color combinations, or which employ only black ink.

We claim:

1. A fluid delivery system for use in a device wherein fluid is delivered from a reservoir to a discharge mechanism which reciprocates relative to the reservoir, said system comprising:

a first tube interconnected to the reservoir and the discharge mechanism, said first tube being formed to define a first helical coil having a first diameter, said first helical coil being capable of expansion and retraction with reciprocation of the discharge mechanism; and a second tube interconnected to the reservoir and the discharge mechanism, said second tube being formed to define a second helical coil having a second diameter smaller than said first diameter and arranged concentrically within said first helical coil, said second helical coil being capable of expansion and retraction with reciprocation of the discharge mechanism.

2. The system of claim 1, wherein said first and second helical coils extend along a linear coil axis which is substantially parallel to a reciprocation axis of the discharge mechanism.

3. The system of claim 1, wherein said first tube is coiled in a first rotational direction and said second tube is coiled in a second rotational direction, said first and second tubes creating a web-like matrix wherein said first and second tubes cross over one another upon expansion of said first and second helical coils.

4. The system of claim 1, wherein the reservoir includes a plurality of off-board fluid compartments remote from the discharge mechanism, and the discharge mechanism includes a plurality of onboard fluid compartments onboard the discharge mechanism, each tube being arranged to connect an off-board fluid compartment to a corresponding onboard fluid compartment.

5. The system of claim 4, wherein each tube carries a different fluid.

6. The system of claim 1, wherein said helical coils define a plurality of springs.

7. The system of claim 6, wherein said springs are biased to pull the discharge mechanism toward the reservoir.

* * * * *